US009970193B1

(12) United States Patent
Boxer

(10) Patent No.: US 9,970,193 B1
(45) Date of Patent: May 15, 2018

(54) SYSTEM AND METHOD FOR THE CONSTRUCTION OF DWELLINGS

(71) Applicant: Jaime Boxer, Montevideo (UY)

(72) Inventor: Jaime Boxer, Montevideo (UY)

(73) Assignee: Boxer Anaya, LLC, Miami, FL (US)

( * ) Notice: Subject to any disclaimer, the term of this patent is extended or adjusted under 35 U.S.C. 154(b) by 0 days. days.

(21) Appl. No.: 15/141,505

(22) Filed: Apr. 28, 2016

(51) Int. Cl.
*E04B 5/32* (2006.01)
*E02D 27/16* (2006.01)
*E04B 5/10* (2006.01)

(52) U.S. Cl.
CPC ..... *E04B 5/32* (2013.01); *E02D 27/16* (2013.01); *E04B 5/10* (2013.01); *E04B 2103/02* (2013.01); *E04B 2103/06* (2013.01)

(58) Field of Classification Search
CPC ..... E02D 27/16; E02D 27/14; E02D 27/08; E02D 27/02; E04B 5/32; E04B 5/326; E04B 5/10; E04B 5/14
USPC ..... 52/167.3, 294, 296, 297, 299, 742.14
See application file for complete search history.

(56) References Cited

U.S. PATENT DOCUMENTS 1,321,213 A * 11/1919 Johnson ..... E04C 2/426 52/321
2,191,804 A * 2/1940 O'Malley ..... 52/407.3
2,856,646 A * 10/1958 Latimer ..... E04B 2/706 403/400
3,890,750 A * 6/1975 Berman ..... E04B 1/30 249/19
4,016,698 A * 4/1977 Rogers ..... E04B 2/706 52/656.1
4,031,687 A * 6/1977 Kuntz ..... E02D 27/14 52/169.9
4,040,232 A * 8/1977 Snow ..... E04B 2/56 248/351
4,122,639 A * 10/1978 Barrell ..... E04B 1/12 52/92.1
4,370,843 A * 2/1983 Menge ..... E04C 3/07 52/657
4,603,532 A * 8/1986 Watson ..... E04L 35/10 52/262
4,660,799 A * 4/1987 Butland ..... A61B 6/00 248/317
5,048,257 A * 9/1991 Luedtke ..... E04B 1/16 52/364
5,373,675 A * 12/1994 Ellison, Jr. ..... E04B 5/10 52/320

(Continued)

FOREIGN PATENT DOCUMENTS

JP 02120416 A * 5/1990
JP 07292803 A * 11/1995

*Primary Examiner* — Adriana Figueroa
(74) *Attorney, Agent, or Firm* — Sanchelima & Associates, P.A.; Christian Sanchelima, Esq.; Jesus Sanchelima, Esq.

(57) ABSTRACT

The present disclosure provides a building construction system and method for preventing the moisture of soil from reaching floor or foundation of the building. The method includes steps of digging in soil for piles to a depth determined based on soil nature, raising plurality of concrete piles from the depth to a height above the ground/grade, connecting the piles using steel beams and placing transversal members between steel beams allowing for blocks to be placed between the transversal members to define a surface wherein concrete can be poured creating a raised foundation floor.

16 Claims, 9 Drawing Sheets

(56) References Cited

U.S. PATENT DOCUMENTS 5,729,950 A * 3/1998 Hardy ..... E04B 2/7453 52/641
5,826,381 A * 10/1998 Sasaki ..... E04B 5/14 52/175
5,944,453 A * 8/1999 Gryba ..... E02D 29/045 405/229
6,067,769 A * 5/2000 Hardy ..... E04C 3/02 52/295
6,269,602 B1 * 8/2001 Thooft ..... E01C 7/14 405/231
6,341,459 B1 * 1/2002 Bates ..... E02D 27/02 52/169.9
6,442,910 B1 * 9/2002 Ellison, Jr. ..... E04B 5/10 52/320
6,748,717 B2 * 6/2004 Sumner, Sr. ..... E02D 27/02 249/65
6,892,504 B1 * 5/2005 diGirolamo ..... E04B 1/08 52/167.3
8,276,328 B2 * 10/2012 Pepin ..... E04B 1/3483 52/167.3
8,528,294 B2 * 9/2013 Vanker ..... E04B 1/24 52/262
8,925,278 B2 * 1/2015 Sugihara ..... E04B 1/58 52/167.3
2005/0066609 A1 * 3/2005 Olah ..... E04B 5/14 52/633
2006/0236628 A1 * 10/2006 Siu ..... E04B 1/24 52/284
2008/0016793 A1 * 1/2008 Majlessi ..... E04B 1/24 52/167.3
2009/0025312 A1 * 1/2009 Deans ..... E04B 5/12 52/167.3
2009/0151298 A1 * 6/2009 Jazzar ..... E04B 1/164 52/745.05
2010/0031587 A1 * 2/2010 Weeks ..... E02D 27/14 52/126.6
2011/0067343 A1 * 3/2011 Rice ..... E04B 1/24 52/653.1
2011/0131896 A1 * 6/2011 Hansen ..... E04B 1/24 52/167.3
2015/0204098 A1 * 7/2015 Perry ..... E04H 9/028 52/167.3

* cited by examiner

SYSTEM AND METHOD FOR THE CONSTRUCTION OF DWELLINGS

BACKGROUND OF THE INVENTION

1. Field of the Invention

The present invention generally relates to the field of construction and a method of building construction. More particularly the present invention relates to a method of building construction to prevent soil moisture to reach the floor of a house or similar dwelling.

2. Description of the Related Art

One of the major problems in field of building construction relates to the transfer of moisture content from soil to floors of building, wherein moisture weakens the buildings. Engineers have recognized this problem for many years, and have designed various solutions to counteract the problem. These solutions have included: placing a gravel layer over the soil prior to placing concrete, placing reinforcing steel in the concrete, post-tensioning the concrete, attempting to maintain constant moisture content in the soils, and numerous other methods that fail to solve the problem in a manner as effective and efficient as the present invention.

Some of the existing solutions for overcoming the problem include preparing the construction site for the foundation by grading, moisture conditioning, and compacting the soils found on site to form a level surface referred to as the "grade," and then constructing a concrete slab directly on top of the grade, leading to the term "slab on grade." While this process has been widely used for many years, it has frequently produced unsatisfactory long-term results when the soils found directly under the slab starts transferring moisture content to the floor due to changing moisture conditions. Specially, when moisture content of the soil increases due to one or other reasons, moisture gets transferred to floor or foundation and may cause distress in the overlying concrete slab/floor or foundation. Due to this and several other reasons, in many parts of the world, slab on grade is not the preferred construction method.

Although engineers have tried various methods to overcome the problems created by transfer of moisture of soils to the building floor or foundation, a completely successful solution has not been devised. Therefore, there exists a need for the methods of building construction disclosed herein that could prevent moisture of soil from reaching the floor or foundation of a structure or dwelling.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a system and method for the construction of dwellings that prevents the exchange of moisture from the soil to the foundation of a structure.

It is another object of this invention to provide such a system that creates a secure foundation capable of withstanding many natural events such as strong winds, storms, etc.

It is still another object of the present invention to provide a system and method of construction that does not require trenches to be dug around the perimeter of a foundation.

It is yet another object of this invention to provide such a system and method of construction that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
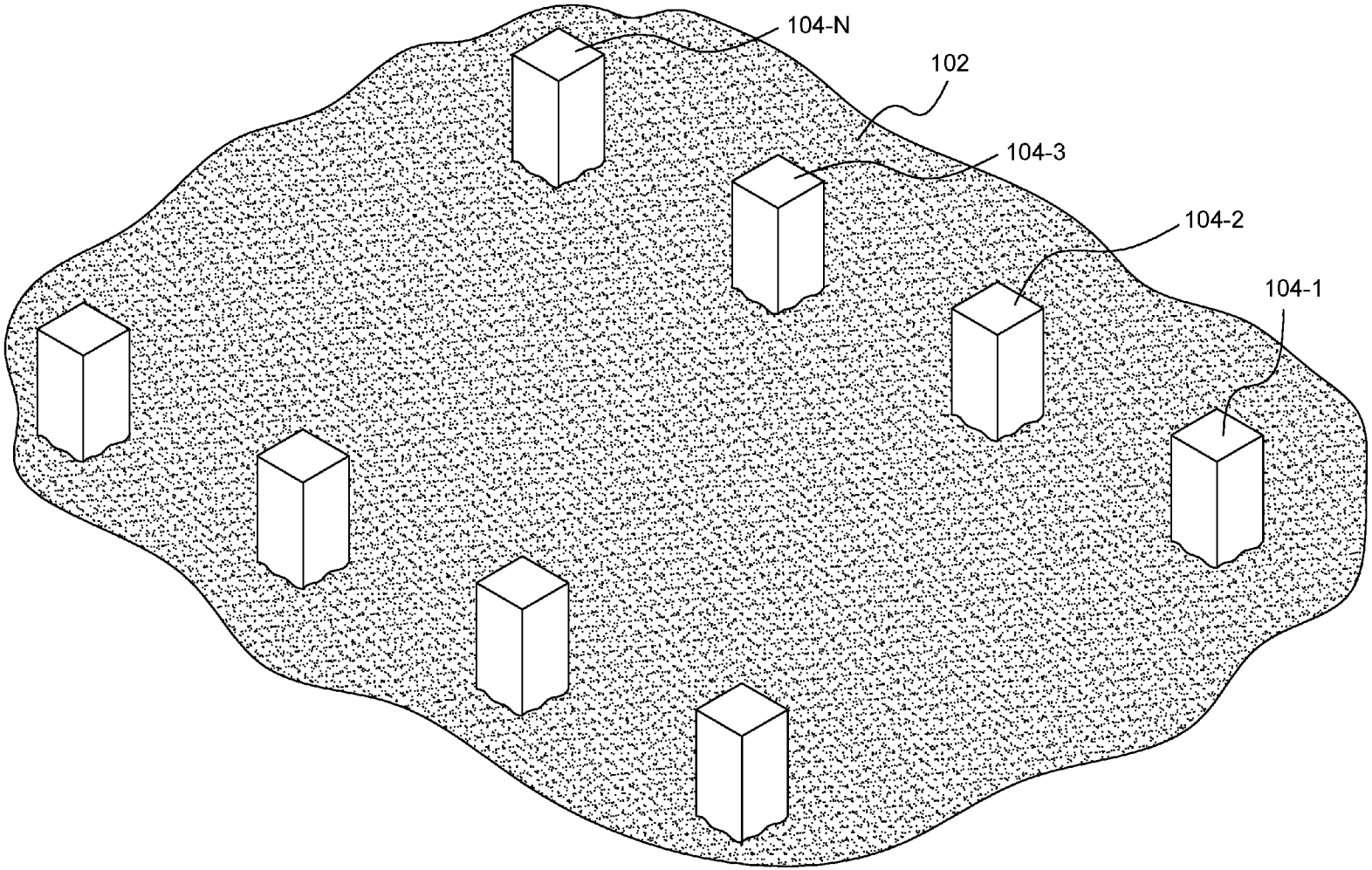
FIG. 1 illustrates exemplary piles, raised above the ground in according with the embodiment of the present disclosure.

An aspect of the present disclosure provides a system and method for building construction to prevent the moisture of soil from reaching the floor or foundation of a building. The method includes steps of digging in soil holes to insert piles to a depth determined based on soil nature, raising plurality of concrete piles from the depth to a height above the ground/grade, mounting steel beams to said piles, placing one or more of reinforcements connecting the piles wherein the reinforcement can be a combination of one or more sections of a material such as steel or wood forms, forming foundation slabs by positioning the transversal members parallel to each other and extending from one perpendicular steel beam to an opposite perpendicular steel beam pouring concrete above or in between the blocks wherein the foundation floor is raised above the ground.

A building can further be erected on the foundation slabs and foundation floor that is a raised floor, above the ground. The proposed method can be used for building construction. The raised floor method can support the foundation slab above the ground at any height and avoid problems due to moisture and pests. The foundation slabs or foundation floor of the building using the method of present disclosure, is above the underlying ground/grade and does not rely on the grade/ground for support and hence prevent the soil moisture from reaching the foundation slabs or foundation floor and building erected above the foundation floor.

An exemplary embodiment of the present disclosure provides a building foundation comprising of plurality of concrete piles having required steel beams and reinforcements, wherein depth of the concrete piles extends below inside soil area where the moisture transfer is minimal and height of the piles is extended to a height above the ground, foundation slabs or reinforcements connecting the piles at the height above the ground wherein the foundation slabs comprises of different combination of and one or more sections of steel reinforcements covered with concrete, and a foundation floor built on the foundation slabs. The foundation floor is formed transversal members supporting a plurality of blocks and then by pouring a layer of concrete.

In an exemplary embodiment, the depth of the piles can be determined based on the nature of soil. In a preferred embodiment, the depth of the pile extends below the area that is influenced by soil moisture and piles can be designed to cut-off or substantially reduce the migration of soil moisture. Chemical treatment and isolation can be provided on the outer surface of piles so as to avoid moisture transfer and pest control.

In exemplary embodiments, combination of and one or more sections of steel beams can be used for connecting the piles, forming the foundation slabs and foundation floor. The foundation floor can be made/erected using grid of metal and concrete blocks placed above or in between the transversal members and pouring concrete above and between them so as to make the floor light and having less contact surface with the concrete piles. By doing so, the floor and the building above the floor will have less contact surface with the concrete piles, which means less transfer of moisture from soil to the building. In addition of overcoming the soil moisture problem, the raised floor system provides numerous advantages.

In accordance with this invention, slab on grade construction where expansive soil is present is avoided. A "slab off grade" technique is provided that supports the foundation slab above the ground. The new foundation system proposed herein addresses the problems summarized above. This new foundation system, "slab off grade," provides for the construction of a concrete slab above the underlying grade, thereby not relying upon the grade for support. A slab off grade foundation preparation apparatus in accordance with the invention comprises a means for digging and mixing means for preparing concrete. Other features of embodiments of the present disclosure will be apparent from accompanying drawings and from detailed description that follows. Embodiments of the present disclosure include various steps, which will be described below. If the specification states a component or feature "may", "can", "could", or "might" be included or have a characteristic, that particular component or feature is not required to be included or have the characteristic.

Exemplary embodiments will now be described more fully hereinafter with reference to the accompanying drawings, in which exemplary embodiments are shown. This disclosure may, however, be embodied in many different forms and should not be construed as limited to the embodiments set forth herein. These embodiments are provided so that this disclosure will be thorough and complete and will fully convey the scope of the disclosure to those of ordinary skill in the art. Moreover, all statements herein reciting embodiments of the disclosure, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating systems and methods embodying this disclosure.

Embodiments of the present disclosure provide methods and building constructed using those methods for preventing the moisture of soil from reaching floor or foundation of the building. The method includes steps of: digging openings in the soil to a predetermined depth depending on the nature of the soil; inserting a plurality of concrete piles from the predetermined depth to a predetermined height above the ground/grade; placing one or more sections of steel beams to form a frame connecting the piles; forming foundation slabs by positioning parallel transversal members from a perpendicular oriented steel beam or steal beam section to an opposite steel beam or steel beam section, adding a plurality of blocks on top of the transversal members so as to define a surface or floor for pouring concrete above or between the transversal members and blocks; thereby creating a foundation floor, wherein the foundation floor has been raised above the ground. Optionally, transversal reinforcement members can be placed or mounted on top of each transversal member that help provide a more secure engagement with the poured concrete. Steel brackets are implemented to support the structural integrity of the construction to be built above, be it of masonry or be it of wood.

A building can then be erected on the foundation slabs and foundation floor that is a raised floor, above the ground. The proposed method can be used for building construction. The raised floor method can support the foundation slab above the ground at any height and avoid problems due to moisture and pests. The foundation slabs or foundation floor of the building using the method of present disclosure, is above the underlying ground/grade and does not rely on the grade/ground for support and, thus, prevents the soil moisture from reaching the foundation slabs or foundation floor of the building or dwelling erected above the foundation floor.

Also, depending on the size of the structure, intermediate steel beams may be used following the method subject of the present invention. Steel concrete decks may not be economically advantageous if they exceed a certain dimension, namely a span of more than 5 meters. The concrete slabs can include various embodiments such as steel deck, ribbed slabs, and/or traditional concrete slabs. These steel brackets are otherwise defined herein as triangle-shaped metal structures and include a vertical member, a base, and at least one diagonal member.

In an exemplary embodiment, the depth of the piles can be determined based on the nature of soil. In a preferred embodiment, the depth of the pile extends below the area that is influenced by soil moisture and piles can be designed to cut-off or substantially reduce the migration of soil moisture. Chemical treatment and isolation can be provided on outer surface of piles so as to avoid moisture transfer and pest control.

In exemplary embodiments, different combination of one or more sections of I-style, C-style or T-style metal beams can be used as steel beams 204 to create the frame connecting the piles. The foundation floor can be made/erected using grid of hollow precast concrete blocks placed above or in between the transversal members and steel beams, or only the transversal members, and pouring concrete. By doing so, the floor and the building above the floor will have less contact surface with the concrete piles, which means even less transfer of moisture from soil to the building. Two I-style beams can be used in the same section or the section can incorporate a combination of two or more I, C, or T-style beams. A combination of I and C-style beams can be seen in FIG. 2A.

In an aspect, proposed design/system can include one or more high slabs supported by the metal frame. In an exemplary aspect, beams of the proposed construction can be strengthened by welding a triangle shaped metal assembly 400 to the beams, wherein the beams 204 form part of the ribbed slab of mezzanine in the corners and in places where there are walls perpendicular to the perimeter walls. In an aspect, strengthening with triangle shaped metal assembly 400 enhances resistance of the construction to winds, making the structure much more reliable. In another aspect, strengthening with triangle shaped metal assembly 400 does not change the wood construction system at all and instead acts as a complement.

Such an application can be used for wooden houses, wherein a very strong base can be welded to the base metal beams and wooden sections fixed to the steel frame. In another aspect, different wood sections can be used by a selection of suitable metallic materials. For example, wood for the house structure can be 2"×4" or in cases of stronger structures, 2"×6", and can be integrated into the steel beams or triangle-shaped metal structure. The wooden wall structure can be completely integrated with the steel structure by bolting with bolts, locknuts, washers and other equivalent means.

In an aspect, the steel beams 204 can be factory made and duly cut and drilled to size and duly normalized for use. Because of the placement of the steel beams 204 and how they are reinforced, wood cladding of the house or termination coating can be implemented in a normal manner. The proposed system of structural reinforcement, namely, triangle-shaped metal structure assembly 400 can be within thickness of the perimeter wall and, thus, totally hidden. Therefore, the present disclosure can provide a structural system for wooden houses that is concealed within the thickness of the outer walls and provides rigidity and wind resistance that no other known system of reinforcement can provide. Furthermore, the proposed construction can be repeated up to the top floor of the house.

The present disclosure does not need beams deep under the soil and therefore there is no need for a trench to be dug in ground that is time consuming and expensive operation. Instead the piles 104 can be dug directly on the ground. Many terms are frequently used to describe raised floor systems in different region. Example includes raised wood floor, raised wood platform floor, raised floor foundation, and crawlspace construction. A raised floor can also be supported by a variety of foundation types, including but not limiting to pier- and beam foundation, continuous foundation walls, and grade beam foundations.

FIG. 1 illustrates exemplary piles 104, raised above ground 102 in accordance with the embodiments of the present disclosure. As shown in FIG. 1, pile 104-1, 104-2, 104-3, 104-N etc, collectively and interchangeably referred as piles 104, can be raised above ground/grade 102. Foundation slabs can be formed on raised piles 104 so as to avoid and/or minimize contact of grade/ground with the foundation slab. Raising the piles, also referred to as foundation piles can include steps of digging holes in ground at different strategic places based on the building plan, placing piles into the holes, wherein the piles may be chemically treated, to put a layer of chemical on the outer wall of the piles that would be raised, connecting piles using a wooden form or steel reinforcements to define a surface for the interior space within the perimeter of the proposed foundation floor, connecting the piles using steel beams to create a frame, and pouring concrete in the hole. The piles are raised to above the ground 102. In an exemplary implementation, the piles can be raised above the ground with help of support structure that can be removed once the piles are solid. In an exemplary implementation, the depth of the piles can extend below the soil area that has minimal properties of moisture transfer. The height of piles at which foundation slabs can be formed can be determined based on the building design, but in any case the height can be above the ground. All the piles can be raised to a predetermined height. Once the piles 104 have been raised to the height above the ground, a foundation slabs can be formed.

Figure 2:
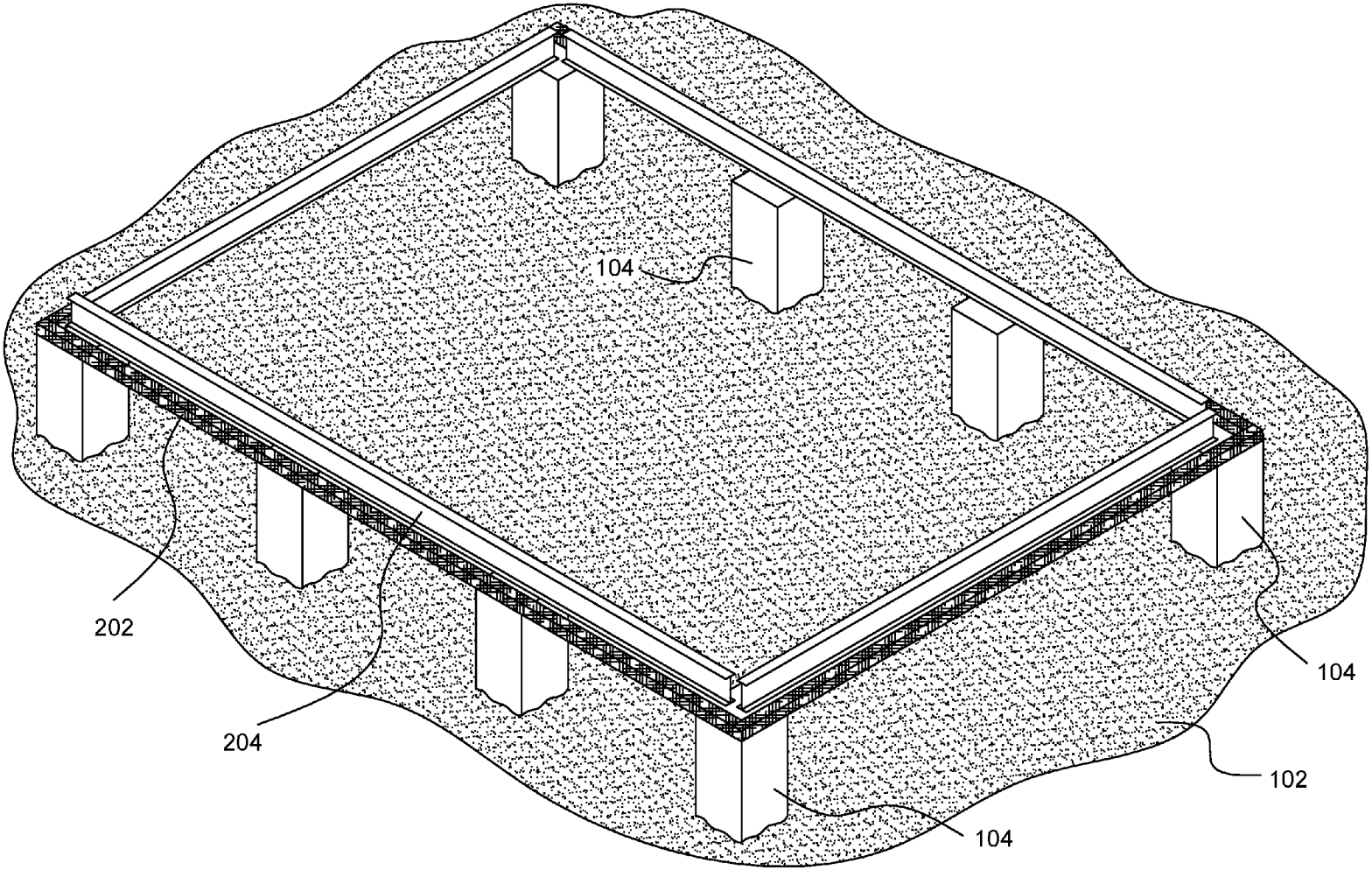
FIG. 2 illustrates an exemplary isolation layer and reinforcement structure that can be used in forming foundation slabs in accordance with an embodiment of the present disclosure. In this embodiment, I-style beams can be seen defining a frame.
Figure 2A:
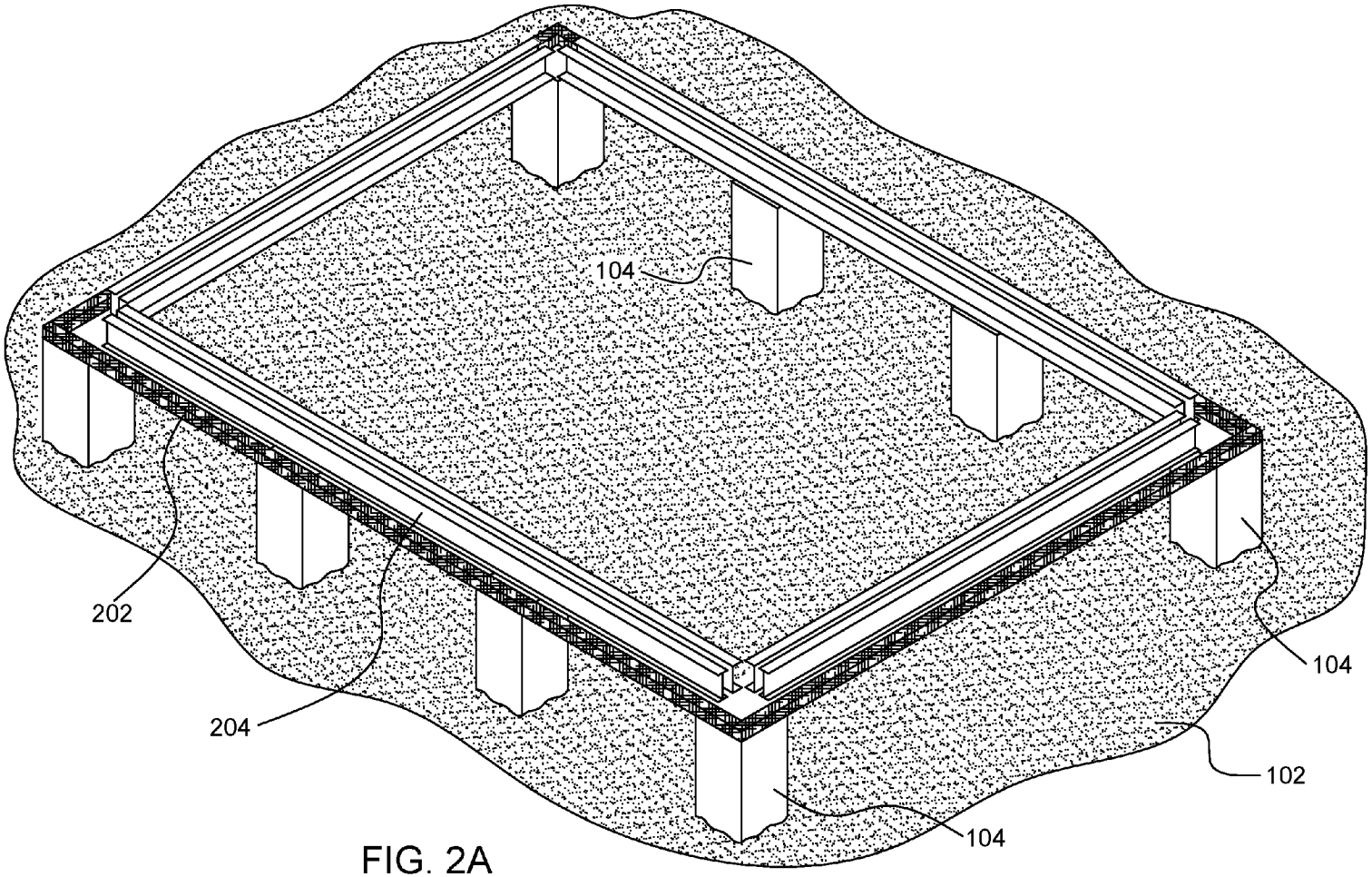
FIG. 2A shows an embodiment of the present invention wherein steel beams that form a frame for the foundation floor are a combination of C-style (seen in the inner perimeter) and I-style beams (seen in the outer perimeter).
Figure 2B:
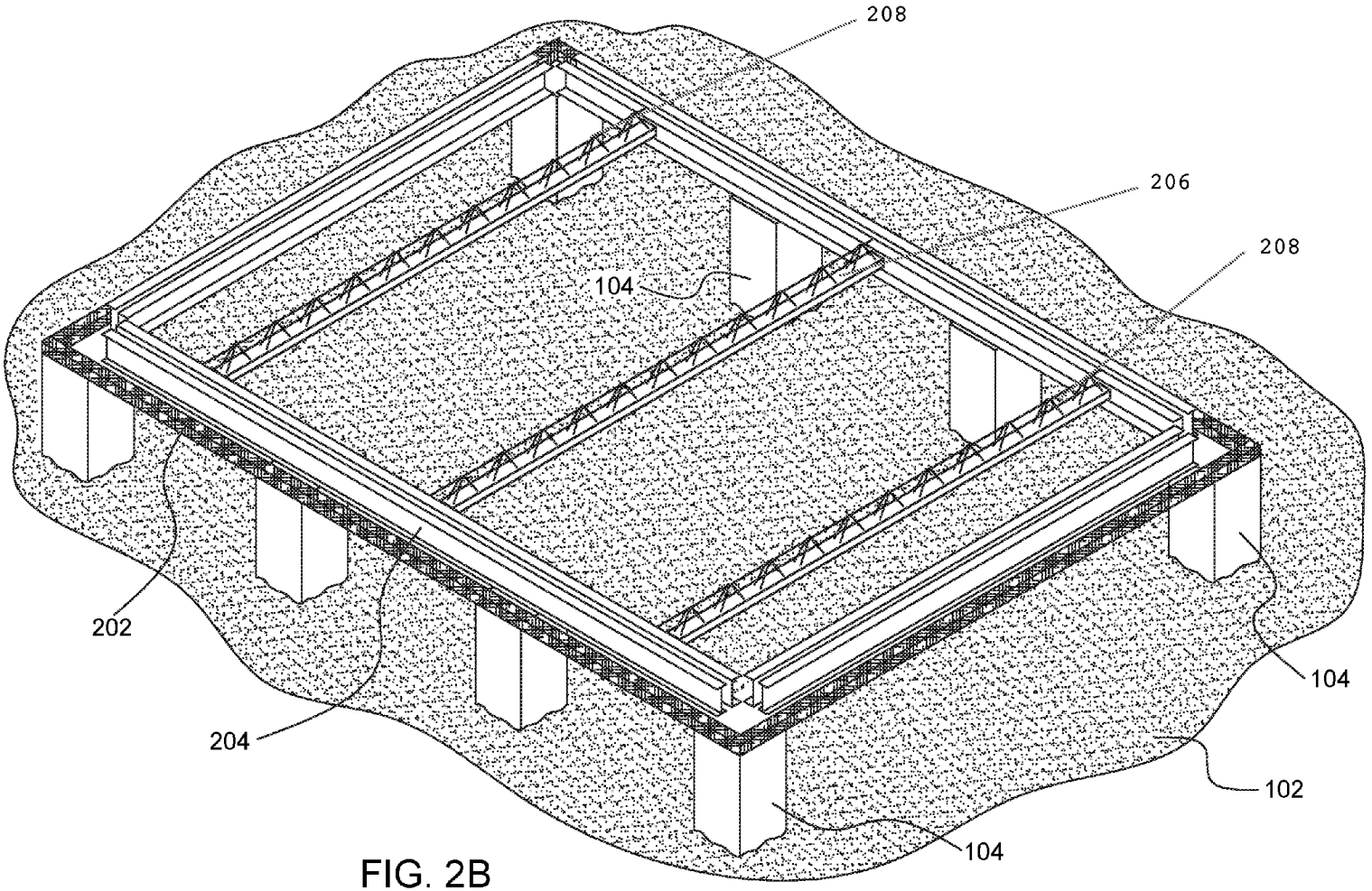
FIG. 2B shows an embodiment of the present invention wherein transversal members 206 are perpendicularly extended with respect to two of the beams 204. Transversal reinforcement members 208 are positioned along the length of transversal members 206.
Figure 2C:
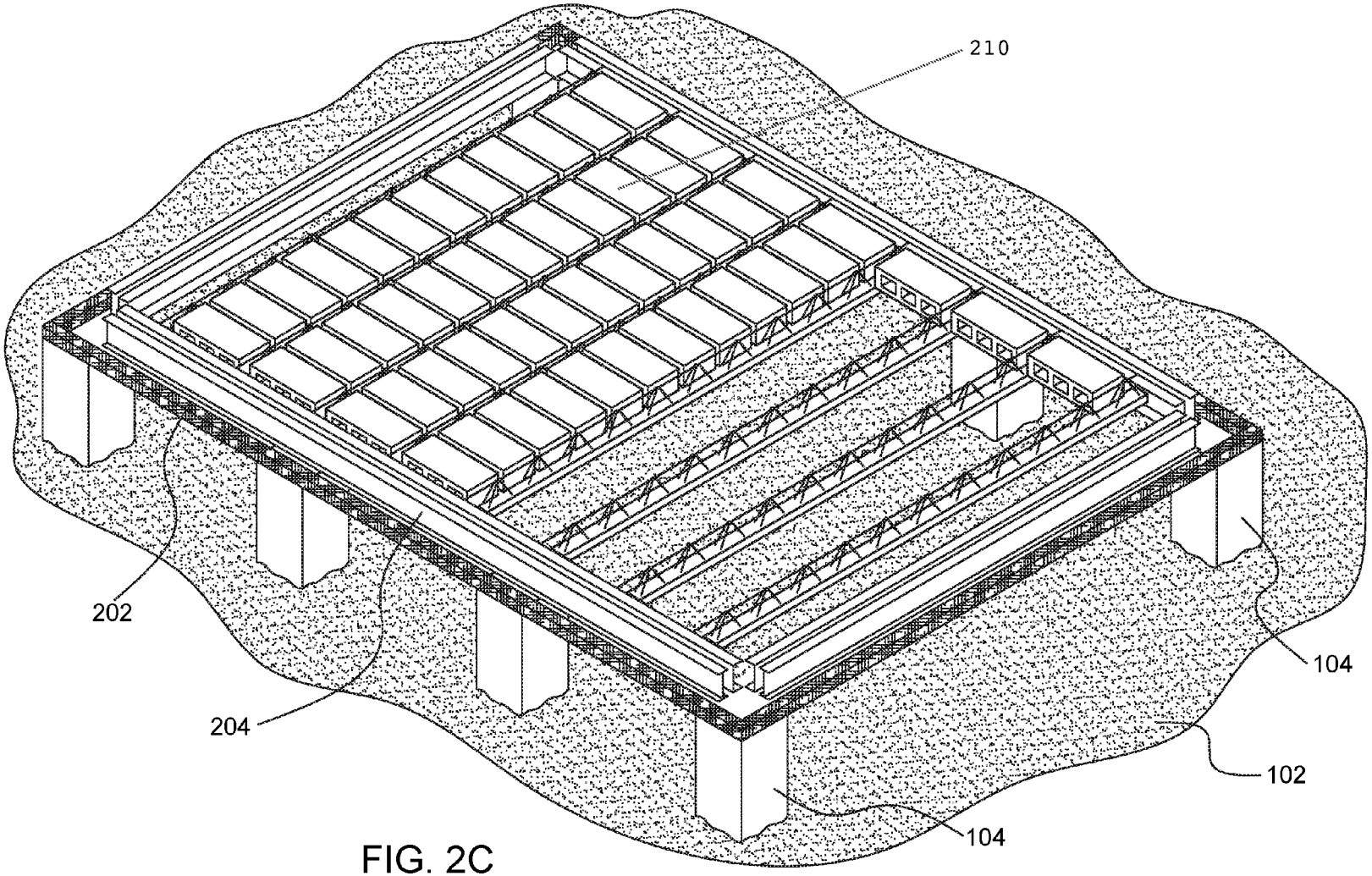
FIG. 2C shows blocks 210 positioned in between transversal members 206 to provide a surface.
Figure 2D:
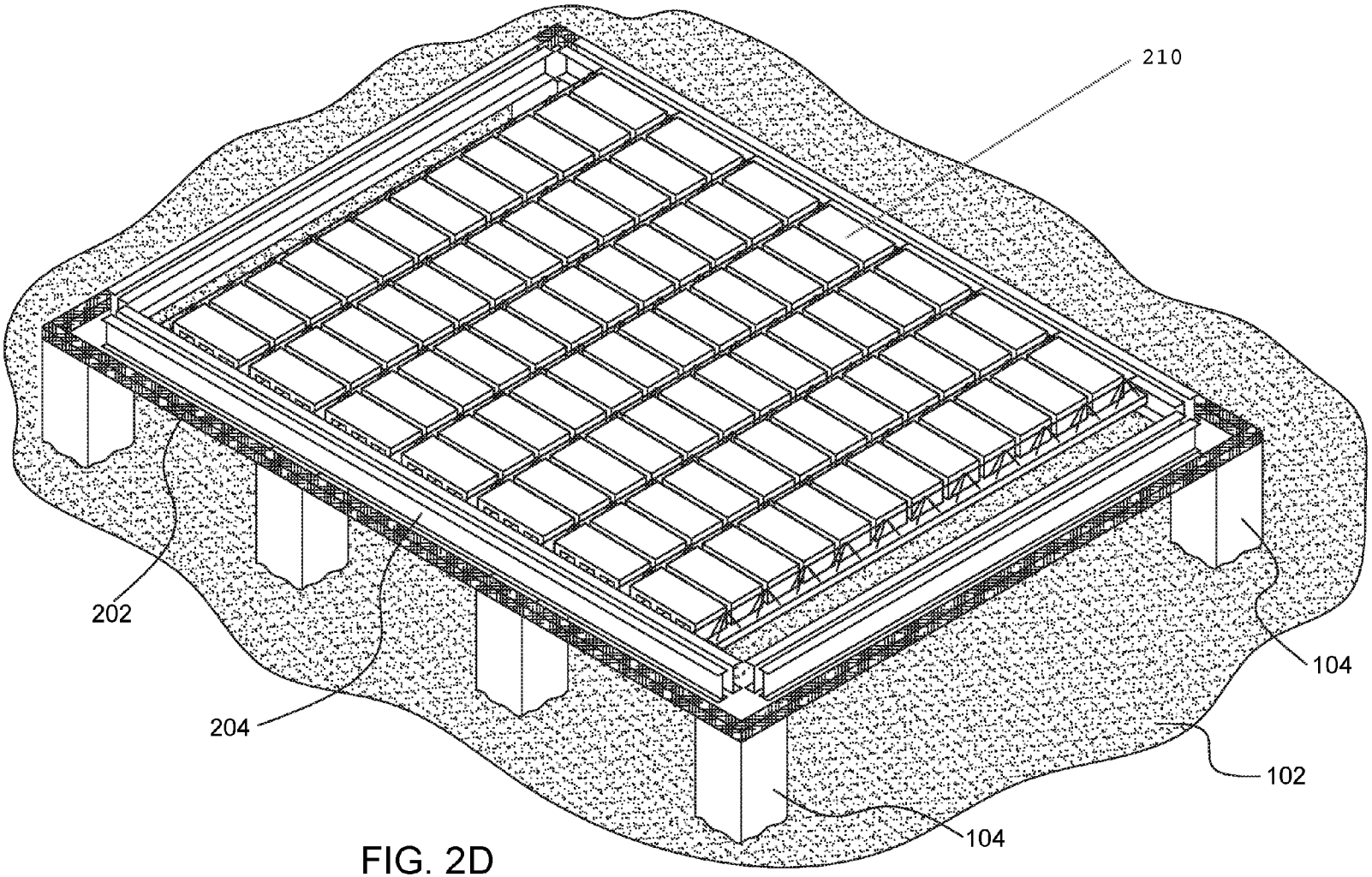
FIG. 2D shows the remaining blocks 210 positioned between transversal members 206 to create the remaining surface.

FIG. 2 illustrates an exemplary isolation layer and reinforcement structure that can be used in forming foundation slabs in accordance with an embodiment of the present disclosure. As shown in FIG. 2, a reinforcement layer 202 of adequate material can be placed above the piles 104. Further, steel beams 204 can be placed to connect different piles 104. In an exemplary embodiment, temporary support structure such as a wooden form or steel reinforcements 202 can define a surface. In addition, intermediate steel beams 310, shown in FIG. 4A, can be used for areas of larger dimensions. Non-metallic or metallic triangle-shaped metal structures can further be implemented to secure the foundation. As shown in FIG. 2B, transversal members 206 are positioned within the interior space of the frame defined by beams 204. Transversal members 206 have transversal reinforcement members 208 mounted thereon along the length of transversal members 206. As shown in FIG. 2C, blocks 210 are them positioned between and supported by transversal numbers 206. As shown in FIG. 2D, blocks 210 are positioned between all transversal members 206 to create a type of floor. Concrete and/or cement can then be poured over and in between blocks 210 to create foundation floor, shown in FIG. 2D. Blocks 210 can be concrete blocks or cinder blocks.

Figure 3:
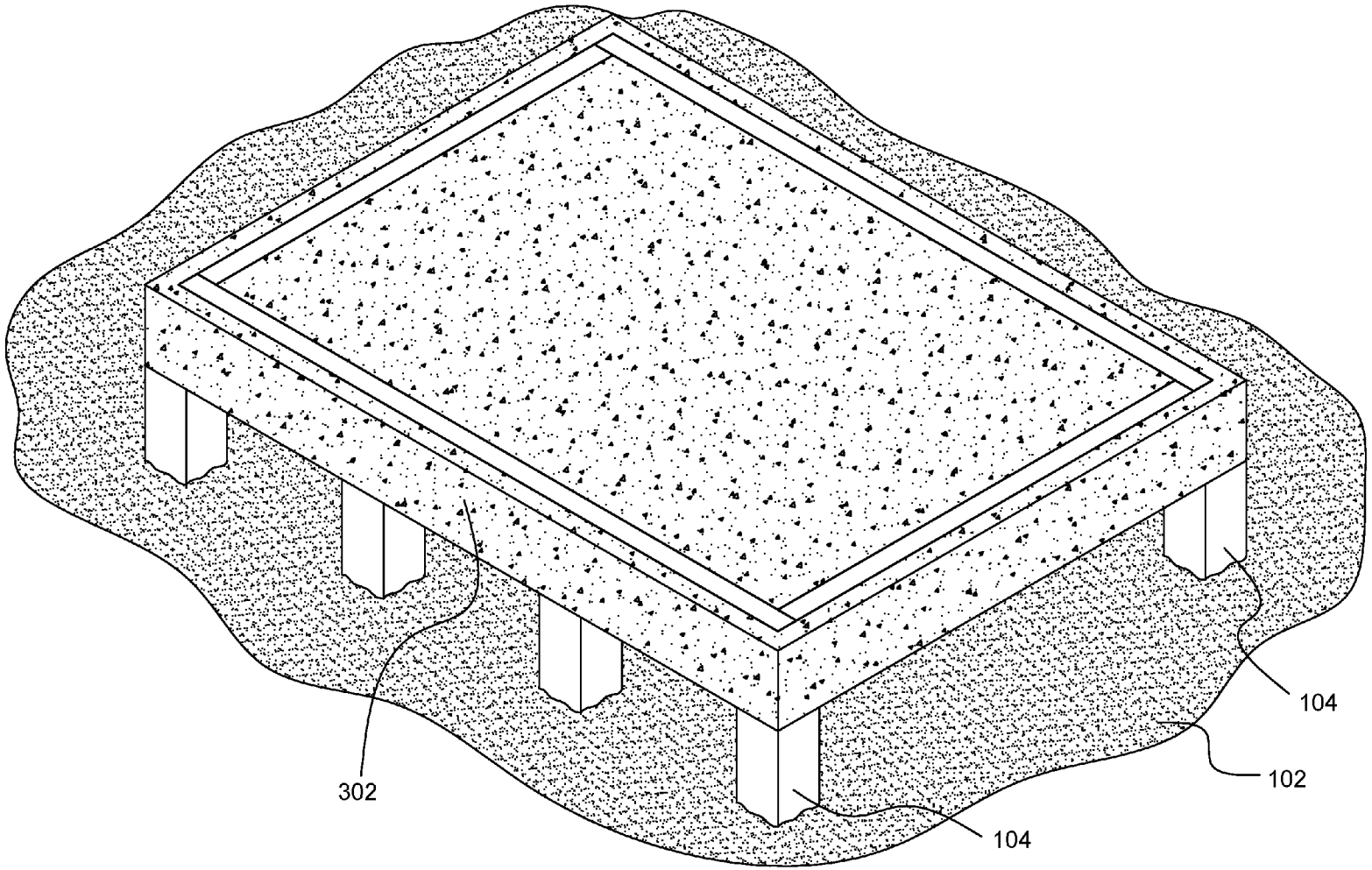
FIG. 3 illustrates an exemplary foundation floor formed in accordance with an embodiment of the present disclosure.

FIG. 3 illustrates an exemplary foundation floor formed in accordance with an embodiment of the present disclosure. As one may appreciate, the foundation floor 302 is formed above the ground. The raised foundation slab and foundation floor prevent the moisture of soil from reaching the foundation floor and building raised above it.

Figure 4:
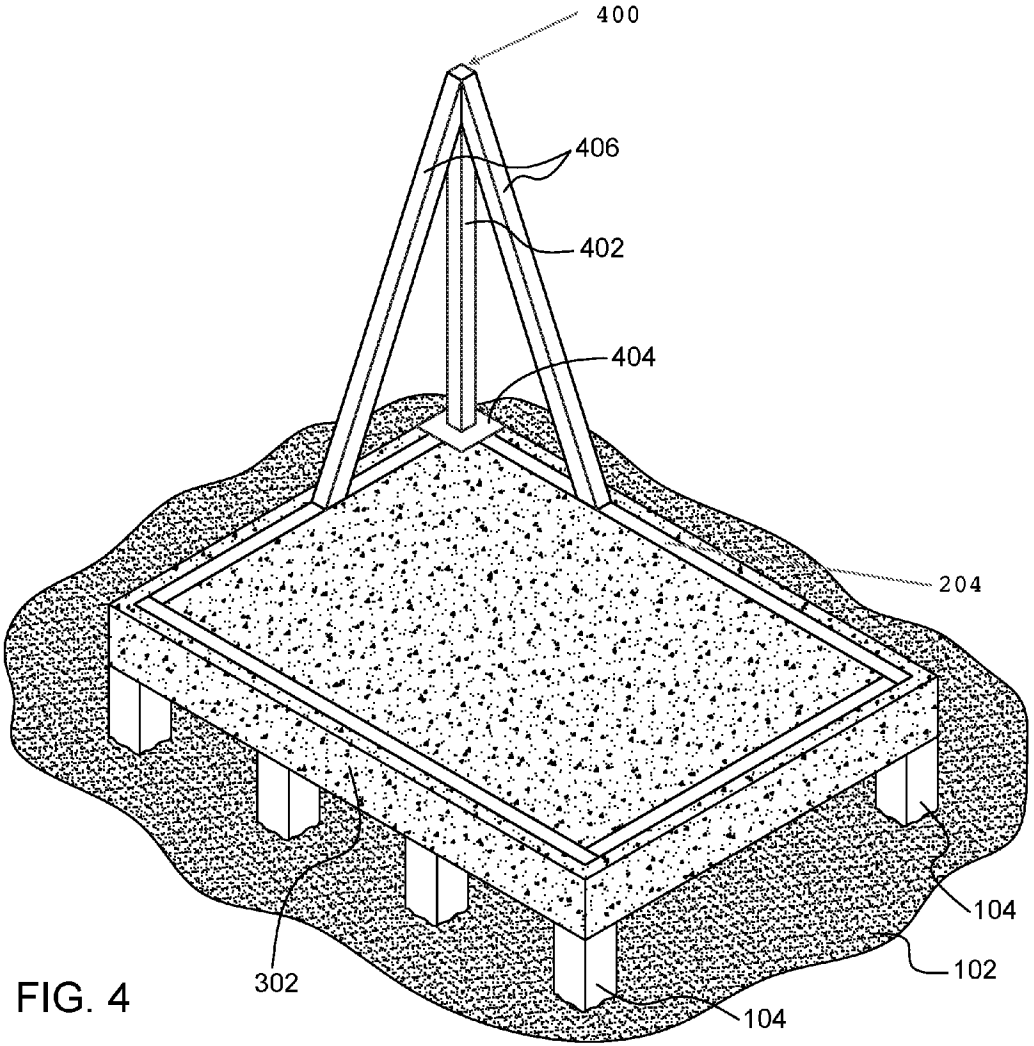
FIG. 4 illustrates an exemplary arrangement of triangle shaped metal structure to strengthen the beams in accordance with an embodiment of the present disclosure.

In an embodiment, casting the foundation floor can be done in such a manner that top surface of the beam 204 remains exposed as shown in FIG. 3 to enable mounting of triangle-shaped metal structures—as described in subsequent paragraph and shown in FIG. 4. A raised foundation floor can also be supported by a variety of foundation types, including but not limiting to pier- and beam foundation, continuous foundation walls, and grade beam foundations.

As used herein, and unless the context dictates otherwise, the term "connected to" is intended to include both direct coupling (in which two elements that are coupled to each other contact each other) and indirect coupling (in which at least one additional element is located between the two elements). Therefore, the terms "coupled to" and "coupled with" are used synonymously. Within the context of this document terms "coupled to" and "coupled with" are also used euphemistically to mean "communicatively coupled with" over a network, where two or more devices are able to exchange data with each other over the network, possibly via one or more intermediary device.

FIG. 4 illustrates an exemplary arrangement of triangle shaped metal structure 400 to strengthen the perimeter walls and/or corners. The triangle shaped structure can comprise a vertically placed vertical member 402 which can be a rectangular steel tube of appropriate size such as 4"×4" supported by a base 404 and can be mounted to the exposed top surface of beam 204, as shown in FIG. 2, of the foundation floor 302, shown in FIG. 3, by welding, bolting or screwing the two together. Vertical member 402 can be further connected to beam 204 by two diagonal members 406 duly fixed to the beam 204 of the foundation floor 302.

Figure 4A:
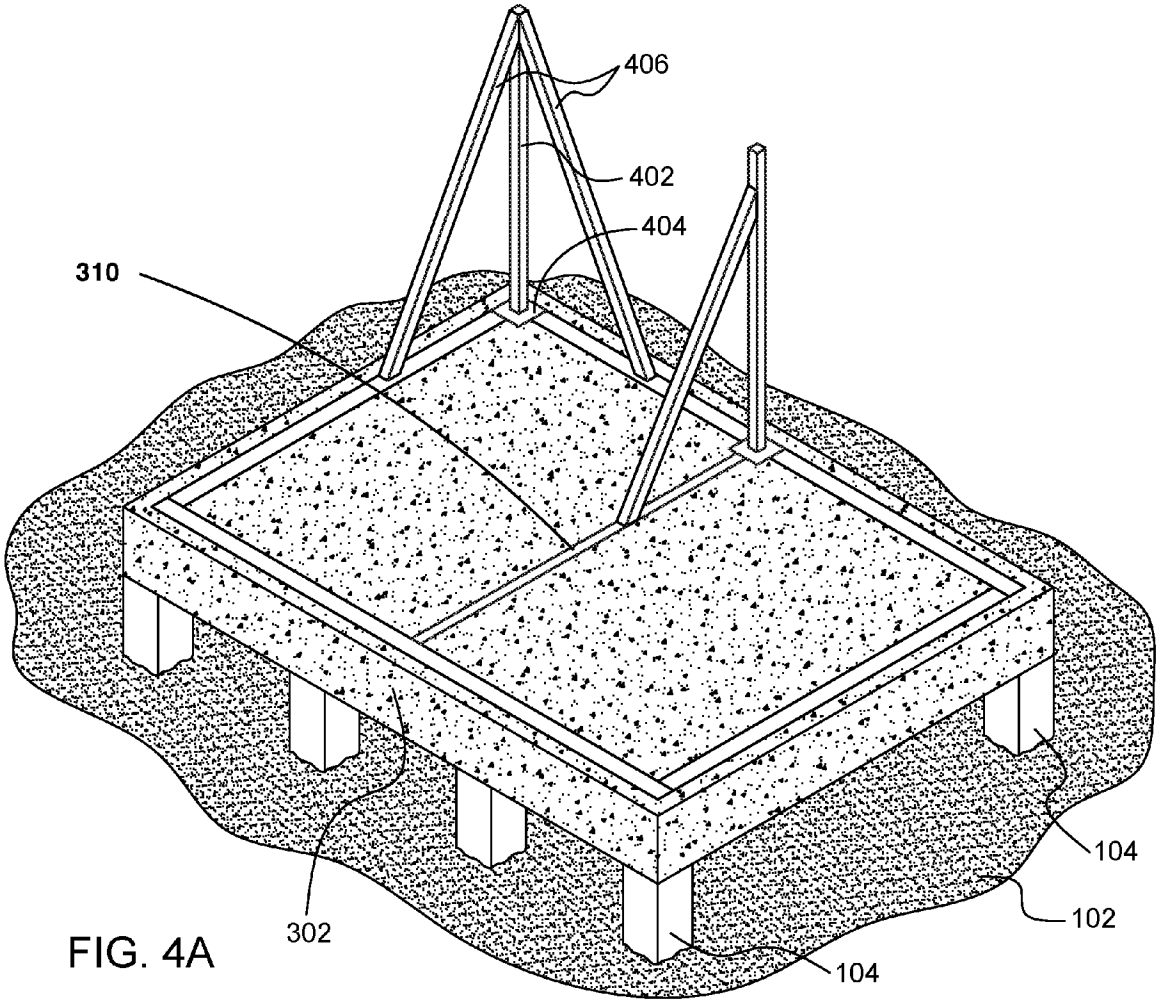
FIG. 4A shows a second triangle shaped metal structure mounted to the foundation floor, the triangle-shaped metal structure can be seen having a vertical and diagonal component and mounted at the foundation floor at a location that cooperates with supporting an interior wall of the dwelling.

In an aspect the triangle shaped metal structures assembly 400 can be configured on at least one corner of the perimeter of the building and can enhance resistance of the construction to winds, making the structure much more durable and reliable. In another aspect, strengthening with the triangle shaped metal structure 400 does not change the wood construction system at all and instead acts as a complement. The triangle-shaped metal structure can also be mounted perpendicular to the perimeter walls and be used to reinforce an interior wall, as seen in FIG. 4A.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

While embodiments of the present disclosure have been illustrated and described, it will be clear that the disclosure is not limited to these embodiments only. Numerous modifications, changes, variations, substitutions, and equivalents will be apparent to those skilled in the art, without departing from the spirit and scope of the disclosure, as described in the claims.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for the construction of structures, comprising:

a plurality of piles each having a first and second end, said first end inserted into the ground to a predetermined depth, a frame having four perimeter sides defining an interior space within said frame, each perimeter side is defined by a C beam adjacent and entirely parallel to an I beam, the entirety of said C beam located closer to said interior space than the entirety of said I beam, each said C beam and each said I beam having a bottom surface, both resting longitudinally directly on top of the second end of said plurality of piles, a plurality of transversal members having a top surface and positioned within said frame, said transversal members having a first and second distal end that are each nestled within said C-beam, a plurality of blocks, each of said blocks located between said transversal members and at least partially resting on said top surface.

2. The system of claim 1 wherein said C beam and said I beam each include a top flange, at least one triangle-shaped structure is mounted to said top flange.

3. The system of claim 2 wherein said at least one triangle-shaped structure includes a base, a vertical member having a top distal end extending from said base, and at least one diagonal member extending from the top distal end of said vertical member, said base being mounted to said beams, said at least one diagonal member mounted to said beams.

4. The system of claim 2 wherein said at least one triangle-shaped structure includes a vertical member and a first diagonal member mounted thereto at a predetermined angle.

5. The system of claim 4 wherein said at least one triangle-shaped structure includes a second diagonal member connected to said vertical member at a predetermined angle.

6. The system of claim 1 wherein said plurality of transversal members are positioned perpendicularly with respect to said C-beams.

7. The system of claim 1 wherein a plurality of transversal reinforcement members are positioned longitudinally along said top surface.

8. The system of claim 2 wherein said triangle-shaped member includes a first and second diagonal member that both extend from said top distal end of said vertical member to said frame, said first diagonal member is mounted to a first side of the frame and said second diagonal member is mounted to a second side of the frame that is perpendicular to the first side of the frame.

9. The system of claim 1 wherein a moisture retardant chemical treatment is applied to said piles.

10. There system of claim 2 wherein said at least one triangle-shaped structure is mounted to said foundation floor at a location that cooperates with supporting a perimeter or interior wall of a dwelling.

11. The system of claim 1 wherein said frame has four comers, the frame's perimeter sides each include one C beam and one I beam that extend perpendicularly towards the C beam and I beam of an adjacent said perimeter side, the C beams and I beams of each perimeter side do not touch or connect to the C beam and I beam of the adjacent perimeter side.

12. A method used in the construction of dwellings including the steps of:

a) opening a plurality of holes in the ground;

b) inserting piles into said holes to a predetermined depth;

c) creating a frame having four perimeter sides by positioning a C beam and an I beam adjacent and parallel to each other on each of said four sides and each said C beam and each said I beam having a bottom surface laid directly on said piles to create said frame;

d) placing a first distal end of transversal members within a C-channel of a first said C beam and placing a second distal end of said transversal members within a C-channel of a second said C beam located on the side of the frame opposite said first C beam, said transversal members having a top surface;

e) placing transversal reinforcement members longitudinally along said top surface;

f) positioning blocks between said transversal members, said blocks supported by and at least partially placed on said top surface; and g) pouring concrete above and between said blocks and said transversal reinforcement members to create a raised foundation floor.

13. The method of claim 12 wherein at least one triangle-shaped structure is mounted adjacent to or at the perimeter of said foundation floor, said triangle-shaped structure having a vertical member and a first diagonal member, said triangle-shaped structure is mounted to said foundation floor at a location that cooperates with supporting a perimeter or interior wall of a dwelling.

14. The method of claim 12 wherein a moisture retardant chemical treatment is applied to said piles.

15. The method of claim 13 wherein a second diagonal component is mounted to said vertical member at a predetermined location to cooperate with providing support for a perimeter or interior wall.

16. The method of claim 12 wherein said plurality of transversal members positioned perpendicularly with respect to said C-beams.

* * * * *